US008157551B2

(12) United States Patent
Ni

(10) Patent No.: US 8,157,551 B2
(45) Date of Patent: Apr. 17, 2012

(54) SCROLL COMPRESSOR WITH BACK PRESSURE POCKET RECEIVING DISCHARGE PRESSURE FLUID

(75) Inventor: Shimao Ni, Bolingbrook, IL (US)

(73) Assignee: Scrollabs Corporation, Bolingbrook, IL (US)

( * ) Notice: Subject to any disclaimer, the term of this patent is extended or adjusted under 35 U.S.C. 154(b) by 540 days.

(21) Appl. No.: 12/364,647

(22) Filed: Feb. 3, 2009

(65) Prior Publication Data

US 2010/0196184 A1 Aug. 5, 2010

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/55.5; 418/55.4; 418/57; 418/144

(58) Field of Classification Search ..... 418/55.1–55.6, 418/57, 180, 270, 104, 144

See application file for complete search history.

(56) References Cited

U.S. PATENT DOCUMENTS

| | | | | |
|---|---|---|---|---|
| 4,384,831 | A * | 5/1983 | Ikegawa et al. | 418/55.5 |
| 4,555,224 | A * | 11/1985 | Hazaki et al. | 418/55.6 |
| 5,277,563 | A | 1/1994 | Wen-Jen | |
| 5,588,820 | A * | 12/1996 | Hill et al. | 418/55.4 |
| 5,829,959 | A | 11/1998 | Tsubono et al. | |
| 6,146,119 | A * | 11/2000 | Bush et al. | 418/55.4 |
| 6,174,150 | B1 * | 1/2001 | Tsubono et al. | 418/55.5 |
| 6,890,163 | B2 * | 5/2005 | Uchida et al. | 418/55.4 |
| 2005/0152793 | A1 | 7/2005 | Bush | |

FOREIGN PATENT DOCUMENTS

| | | | |
|---|---|---|---|
| DE | 3402548 | A1 | 8/1985 |
| DE | 19623215 | A1 | 12/1997 |
| DE | 19853240 | A1 * | 5/2000 |
| EP | 380439 | A2 | 8/1990 |
| JP | 54157315 | A | 12/1979 |

OTHER PUBLICATIONS

International Search Report dated Jul. 28, 2010.

International Preliminary Report on Patentability Aug. 18, 2011.

* cited by examiner

*Primary Examiner* — Theresa Trieu

(74) *Attorney, Agent, or Firm* — Carlson, Gaskey & Olds, PC

(57) ABSTRACT

A face of a base of an orbiting scroll member is aligned with a thrust bearing. The thrust bearing includes a back pressure pocket and a seal for sealing the back pressure pocket to entrap a compressed fluid. There is a tap for tapping fluid at a discharge pressure into said back pressure pocket.

11 Claims, 2 Drawing Sheets

SCROLL COMPRESSOR WITH BACK PRESSURE POCKET RECEIVING DISCHARGE PRESSURE FLUID

BACKGROUND OF THE INVENTION

This application relates to a scroll compressor wherein a back pressure pocket is provided with a fluid supply from a discharge pressure chamber.

Scroll compressors are becoming widely utilized in fluid compression applications. In a scroll compressor, a pair of scroll elements each have a base and a generally spiral wrap extending from their base. The wraps interfit to define compression chambers. One of the two scroll elements is caused to orbit relative to the other, and as this orbiting occurs, compression chambers define between the wraps decrease in volume and an entrapped fluid is compressed.

There are many challenges with a scroll compressor. One challenge is that the internal pressure in the compression chambers tends to force the two scroll members away from each other. To address this challenge, a bias force is applied to urge the two scroll members together.

Scroll compressors are formed with a thrust bearing that acts in opposition to the bias force. The bias force is known to be behind a non-orbiting scroll member in some scroll compressors, and behind the orbiting scroll member in other scroll compressors. In scroll compressors wherein the bias force is placed behind the non-orbiting scroll member, the thrust bearing is on a rear face of the base of the orbiting scroll member. In scroll compressors wherein the bias force is behind the rear face of the orbiting scroll member, the thrust bearing is positioned at radially outer locations on a forward face.

It is known to use a seal that receives a partially compressed fluid as part of the thrust bearing. Typically, a tap taps fluid at an intermediate compression point to a seal chamber.

There are deficiencies with this arrangement. In particular, there are losses due to the cyclic feeding and draining of this back pressure pocket across the tap hole, as the tap hole orbits relative to the pocket. The fluid can actually be bypassed from one compression pocket to the next, with resulting efficiency losses. In addition, the width of the seal chamber must be sufficiently wide so the tap will always be in communication throughout the orbiting cycle.

SUMMARY OF THE INVENTION

A face of a base of an orbiting scroll member is in contact with a thrust bearing. The thrust bearing includes a back pressure pocket and a seal for sealing the back pressure pocket to entrap a compressed fluid. There is a tap for tapping fluid at the discharge pressure into said back pressure pocket.

These and other features of the present invention can be best understood from the following specification and drawings, the following of which is a brief description.

DETAILED DESCRIPTION OF THE PREFERRED EMBODIMENT

Figure 1:
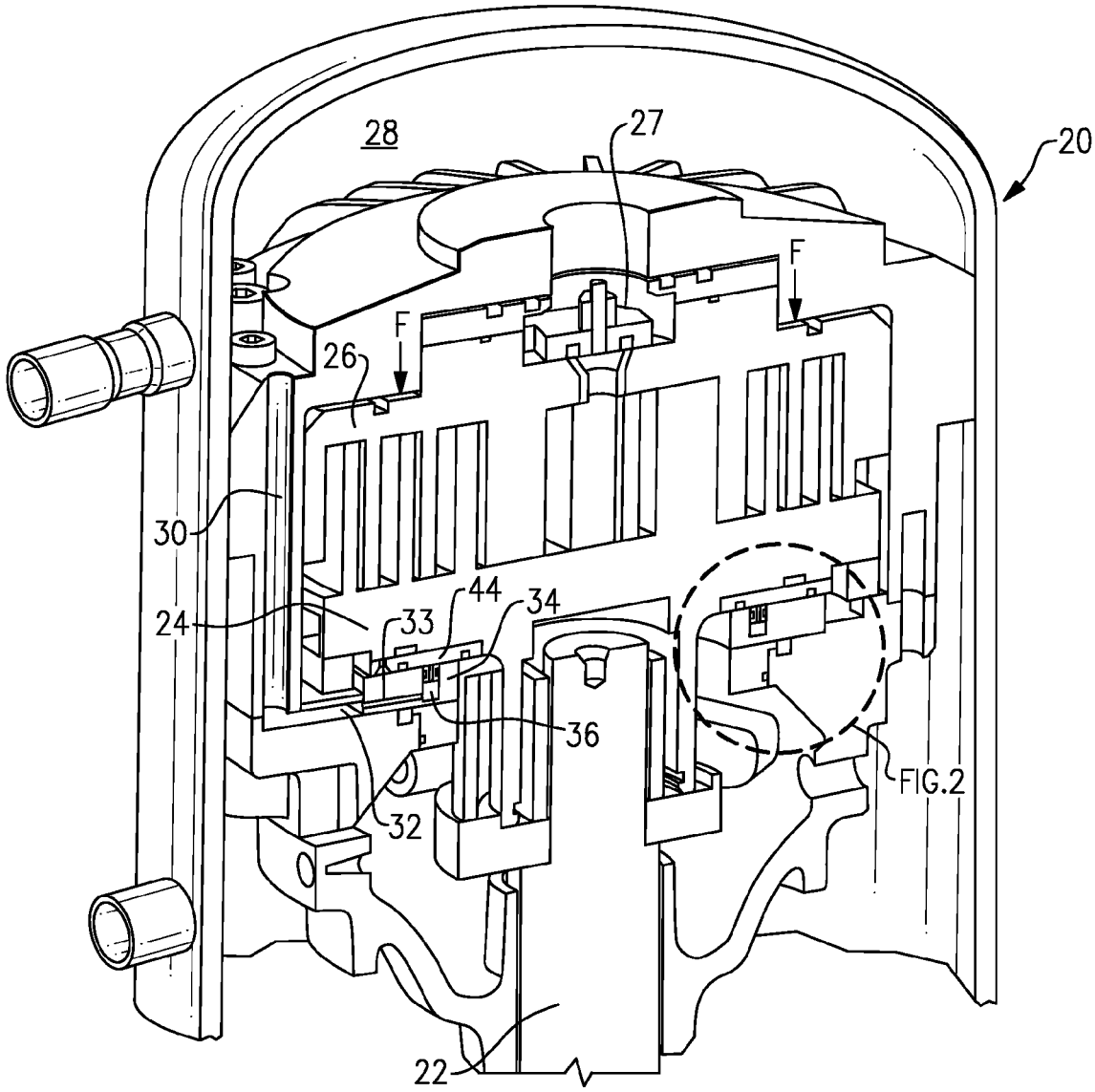
FIG. 1 is a cross-sectional view through a scroll compressor incorporating the present invention.
Figure 2:
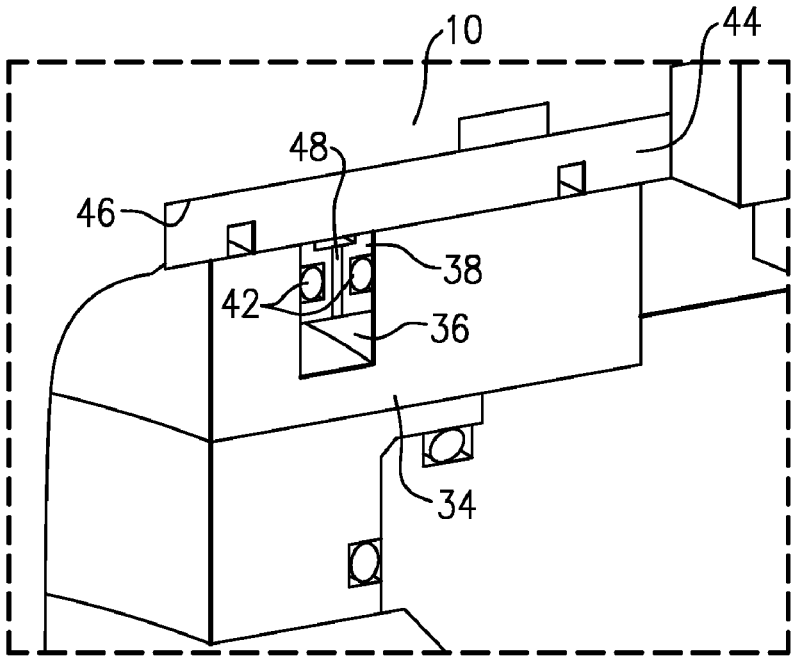
FIG. 2 is an enlarged view of a portion of the FIG. 1 compressor.

FIG. 1 shows a compressor 20 incorporating a shaft 22 that is driven to rotate by a motor (not shown). FIG. 2 shows a portion of the compressor 20. The shaft causes an orbiting scroll member 24 to orbit through a non-rotation coupling, as known. The orbiting scroll member 24 has a wrap which interfits with a wrap on a non-orbiting scroll member 26. As shown, a force F biases one of the scroll elements toward the other. In the FIG. 1 embodiment, the bias force F is directed to urge the non-orbiting scroll member 26 toward the orbiting scroll member 24. The bias force may be created by a tapped compressed fluid, or by a mechanical element such as a spring. The bias element is disclosed here schematically by the letter F, and a worker of ordinary skill in the art would recognize how to provide such a bias force.

As the two scroll members 24 and 26 orbit relative to each other, fluid is compressed in compression chambers defined between the wraps of the two scroll members 24 and 26. This fluid is compressed toward a central discharge port 27, and discharged into a discharge pressure chamber 28.

While this application will refer to the scroll wraps as being "generally spiral," it should be understood that this term would extend to so-called "hybrid" wrap scroll compressors wherein the shape of a scroll wrap is a series of connected curves, rather than a pure spiral. Still, all scroll wraps do extend along curves from a central point radially outwardly, and wrapping around each other. The term "generally spiral" as used in this application extends to all such shapes. While the force is shown behind the non-orbiting scroll member 26, it is also known to apply a bias force behind the orbiting scroll member 24, and the teachings of this invention would extend to such a scroll compressor.

As shown, a tap 30 taps this discharge pressure fluid downwardly, and radially inward through a crankcase passage 32, into a passage 33 through a thrust bearing 34. As shown, passage 30 is radially outwardly of the scroll members 24 and 26. This fluid passes into the back pressure pocket 36.

Figure 3:
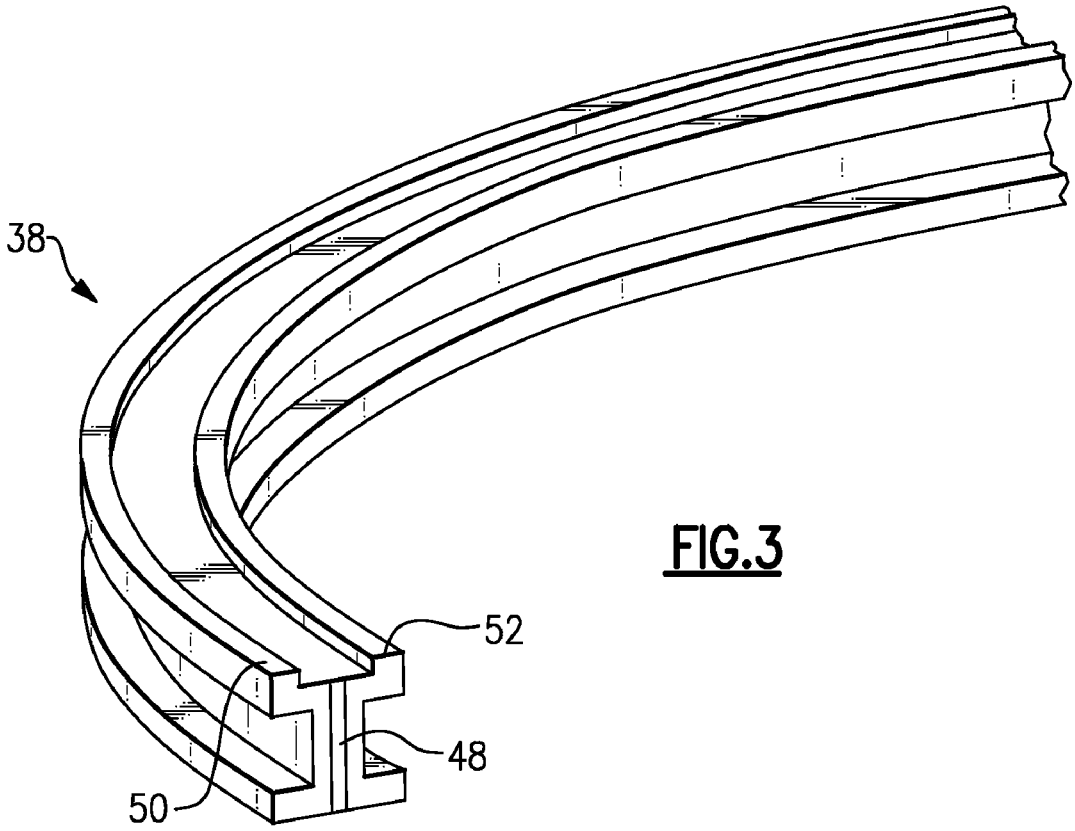
FIG. 3 shows a detail of a seal element.

As shown in FIGS. 2 and 3, a ring 38 has o-rings 42 at radially outer and radially inner locations to seal the pocket 36. As can be appreciated, the pocket 36 is internal to the thrust bearing 34. Of course, other seal types may be used. A passage 48 is provided through the ring 38 to connect its lower and its upper face. The upper face of the ring is provided with a groove defining two lips 50 and 52 able to seal the pocket when the ring is in contact with the wear plate 44 arranged in a recess 46 formed in the base of orbiting scroll member 24. Pressure distribution on both sides of the ring maintain it in contact with the wear plate, and allow fluid at discharge pressure to act at the rear of the orbiting scroll. In this manner, a force is provided to resist a thrust of an orbiting scroll member 24 downwardly, and away from the non-orbiting scroll 26.

The thrust bearing 34 may be a sintered impregnated bronze thrust bearing.

With the invention, the radial width of the back pressure chamber 36 may be made smaller than in the prior art. The back pressure chamber 36 will always communicate with its pressure source, and the orbit radius will not matter. Also, the discharge pressure will be at a more constant pressure than the intermediate pressure as used in the prior art.

While the thrust bearing 34 is shown on a rear face of the base of an orbiting scroll member 24, scroll compressors are also known which have the thrust bearing on a radially outer location of the forward face of the base of the orbiting scroll member. Such an application is typically used when the bias force F is provided to urge the orbiting scroll member 24 upwardly and toward the non-orbiting scroll member. This invention would apply to such arrangements also.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base;

a shaft driven to rotate, and to in turn cause said second scroll member to orbit relative to said first scroll member, orbiting of said second scroll member relative to said first scroll member compresses a fluid entrapped in compression chambers between the wraps of the first and second scroll members, and the fluid being compressed towards a discharge port in the first scroll member, and delivered into a discharge pressure chamber;

a face of the base of the second scroll member being in contact with a thrust bearing, said thrust bearing including a back pressure pocket, internal to said thrust bearing and a seal for sealing said back pressure pocket to entrap a compressed fluid, and a tap for tapping fluid at a discharge pressure into said back pressure pocket;

a wear plate being positioned on a rear face of said second scroll member and facing said thrust bearing; and said seal including a ring that is in contact with said wear plate, and said ring providing said seal.

2. The scroll compressor as set forth in claim 1, wherein said tap taps fluid from said discharge pressure chamber through a housing, into a passage through the thrust bearing, and into the back pressure pocket.

3. The scroll compressor as set forth in claim 2, wherein said tap includes a passage positioned radially outwardly of a radial outermost extent of said first and second scroll members, and to a radially extending passage which communicates through said thrust bearing to said back pressure chamber.

4. The scroll compressor as set forth in claim 1, wherein seals are mounted in said ring at radially inner and radially outer locations to provide a fluid tight contact.

5. The scroll compressor as set forth in claim 1, wherein the back pressure pocket is on an opposed side of said ring from said face of the base of the second scroll member, and a passage extends through said ring to communicate the fluid to the face of the base of the second scroll member.

6. The scroll compressor as set forth in claim 5, wherein radially spaced lips surround the passage to provide a seal at a face of the ring that is in contact with said wear plate.

7. The scroll compressor as set forth in claim 5, wherein said tap communicating with a passage passing through said thrust bearing to communicate compressed fluid into said back pressure pocket.

8. The scroll compressor as set forth in claim 1, wherein it is a rear face of the base of the second scroll member that is in contact with the thrust bearing.

9. The scroll compressor as set forth in claim 1, wherein said tap communicating with a passage passing through said thrust bearing to communicate compressed fluid into said internal back pressure pocket.

10. A scroll compressor comprising:

a first scroll member having a base and a generally spiral wrap extending from said base;

a second scroll member having a base and a generally spiral wrap extending from its base;

a shaft driven to rotate, and to in turn cause said second scroll member to orbit relative to said first scroll member, orbiting of said second scroll member relative to said first scroll member compresses a fluid entrapped in compression chambers between the wraps of the first and second scroll members, and the fluid being compressed towards a discharge port in the first scroll member, and delivered into a discharge pressure chamber;

a rear face of the base of the second scroll member being in contact with a thrust bearing, said thrust bearing including a back pressure pocket, and a seal for sealing said back pressure pocket to entrap a compressed fluid, and a tap for tapping fluid from said discharge pressure chamber through a passage positioned radially outwardly of a radial outermost extent of said first and second scroll members, and to a radially extending passage which communicates through said thrust bearing to said back pressure pocket; a wear plate is positioned on a rear face of said second scroll member and is in contact with said thrust bearing, said seal including a ring that is in contact with said wear plate, and said ring providing said o-rings mounted in said ring at radially inner and radially outer locations to provide a fluid tight contact; and wherein radially spaced lips surround the passage to provide a seal at a face of the ring that is in contact with said wear plate.

11. The scroll compressor as set forth in claim 10, wherein the back pressure pocket is on an opposed side of said ring from said face of the base of the second scroll member, and a passage extends through said ring to communicate the fluid to the face of the base of the second scroll member.

* * * * *